US007116051B2

(12) United States Patent
Vancil et al.

(10) Patent No.: US 7,116,051 B2
(45) Date of Patent: Oct. 3, 2006

(54) MULTIBEAM KLYSTRON

(76) Inventors: Bernard K. Vancil, 21070 SW. Tile Flat Rd., Beaverton, OR (US) 97007; Edwin G. Wintucky, 38295 Cheltenham Rd., Willoughby, OH (US) 44094

( * ) Notice: Subject to any disclaimer, the term of this patent is extended or adjusted under 35 U.S.C. 154(b) by 0 days.

(21) Appl. No.: 10/888,093

(22) Filed: Jul. 9, 2004

(65) Prior Publication Data

US 2005/0023984 A1 Feb. 3, 2005

Related U.S. Application Data

(60) Provisional application No. 60/488,075, filed on Jul. 16, 2003, provisional application No. 60/488,350, filed on Jul. 17, 2003.

(51) Int. Cl.
*H01J 25/00* (2006.01)

(52) U.S. Cl. ..... 315/5; 315/5.34; 315/5.35

(58) Field of Classification Search ..... 315/5
See application file for complete search history.

(56) References Cited

U.S. PATENT DOCUMENTS

| | | | | |
|---|---|---|---|---|
| 3,289,031 | A * | 11/1966 | Hiramatsu et al. | 315/3.5 |
| 3,436,588 | A | 4/1969 | Hechtel | 315/5.34 |
| 4,433,270 | A | 2/1984 | Drozdov et al. | 315/5.35 |
| 4,731,598 | A * | 3/1988 | Clarke | 335/210 |
| 4,749,906 | A | 6/1988 | Tran et al. | 315/5 |
| 4,789,808 | A * | 12/1988 | Hayashi | 315/4 |
| 5,373,263 | A * | 12/1994 | Wharton | 331/96 |
| 6,593,695 | B1 * | 7/2003 | Theiss | 315/3.5 |
| 6,747,412 | B1 | 6/2004 | Vancil | 315/3.5 |
| 2002/0167276 | A1 | 11/2002 | Vancil | 315/3.5 |

OTHER PUBLICATIONS

Microwave Tubes, Proceedings of the 5th International Congress, Paris, Sep. 14-18, 1964, The 5th International Conferences on Microwave Tubes, A One Kilowatt CW Electrostatically Focused Klystron for C-Band Communications, R.M. Briggs, J. Lind, A.J. Prommer.

Microwave Tubes, Proceedings of the 5th International Congress, Paris, Sep. 14-18, 1964, The 5th International Conferences on Microwave Tubes, "Further Advances in the Electrostatically Focused Klystron Amplifiers", J.R. Hechtel and A. Mizuhara, pp. 230-232.

Microwave Tubes, Proceedings of the 5th International Congress, Paris, Sep. 14-18, 1964, The 5th International Conferences on Microwave Tubes, "Efficiency Enhancement in Blased Klystrons", J. Walder, S.C. Wanage, P.R. McIssac and H.R. Witt, pp. 276-280.

Electronics, Dec. 28, 1962, New Design Concept Reduces Klystron Weight, S.R. Mechtel and A. Mizuhara, pp. 36-37.

* cited by examiner

*Primary Examiner*—Wilson Lee
*Assistant Examiner*—Binh Van Ho
(74) *Attorney, Agent, or Firm*—Dellett & Walters patenttm.us

(57) ABSTRACT

A multibeam, electrostatically focused klystron includes a plurality of conductive members, ones of which are recessed to provide input and output sections of microwave cavities, wherein focusing voltage is applied between those sections. The conductive members are either spaced along the path of multiple beams, or stacked in insulated relation, in either case being supported by glass rods within a glass envelope.

13 Claims, 4 Drawing Sheets

MULTIBEAM KLYSTRON

Figure 1:
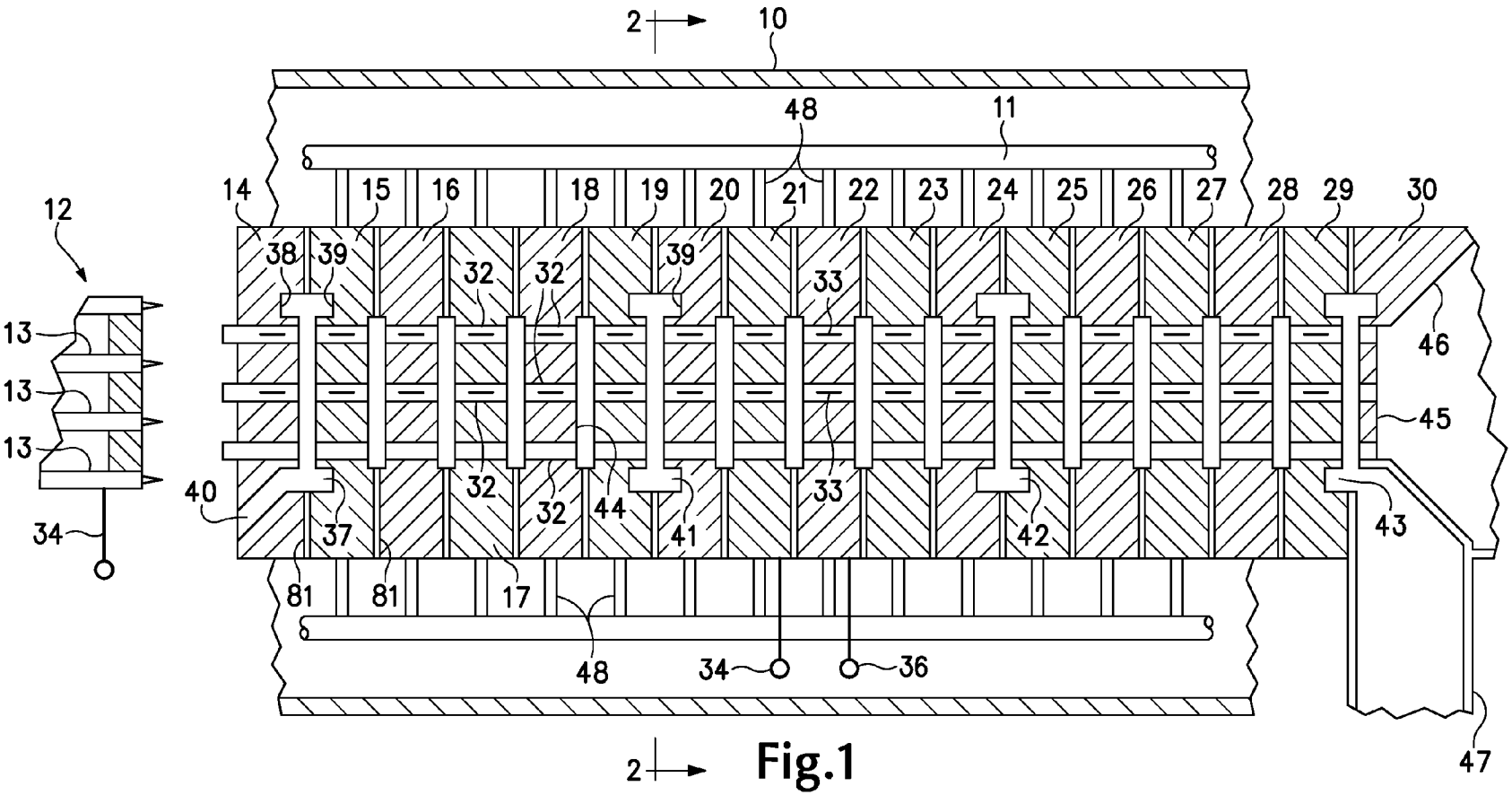

This invention was made with Government support under NASA contract. The Government has certain rights in this invention.

BACKGROUND OF THE INVENTION

The present invention relates to a multibeam klystron and particularly to a multibeam klystron exhibiting a high bandwidth and substantial power output at high frequencies.

Klystrons can be used both as amplifiers of microwave energy and as oscillators. They consist of three elements: an electron gun which generates a pencil-like flow of electrons accelerated to high energy, a microwave interaction region where the energy in the electron beam is converted to microwave energy, and finally a collector to collect the spent electrons and recover energy that remains. In the aforementioned interaction region the electron beam passes through the center of an r.f. excited toroidal cavity employed for the purpose of accelerating and decelerating electrons in the electron beam at the rate of the r.f. energy in the cavity. The electron beam is then directed via one or more intermediate cavities, to an output cavity where amplified r.f. energy is withdrawn. In the region along the electron beam between the input and output cavities, "bunching" of the electron beam takes place, this effect being enhanced by the intermediate cavities. The bunching of the electron beam produces a strong r.f. field in the output cavity.

The conventional single beam klystron has a disadvantage in that it amplifies only over a relatively narrow band of frequencies due to the high Q of the microwave cavities. A further problem associated with conventional single beam klystrons is that the single beam must have relatively high perveance and DC electron density to provide enough beam power to produce substantial microwave output. High perveance and electron density mean high repulsive forces between electrons in the beam, causing bunching to be inhibited whereby the desired current density variations in the beam are limited.

Most klystrons employ a heavy magnetic structure for the purpose of focusing the comparatively high power beam. The structure may comprise permanent magnets or electromagnets that in any case account for substantial weight and large size for an otherwise relatively small electronic device. These weight and size factors, as well as the undesirable surrounding magnetic field, are limiting factors for a number of uses of the device. Electrostatic focusing proposed for single beam klystrons is not suitable for most high power applications and in any case proposals for electrostatic focusing have involved the same heavy klystron envelope structure utilized for permanent magnets or electromagnets.

If, instead of employing but a single beam, several parallel electron beams were to be used, then each beam can have lower perveance and thus provide large current variations, but in the aggregate, the total power output can be comparatively high. An ancillary benefit would be lower voltage for a given power. Further advantages of a multibeam structure are higher basic efficiency and wider bandwidth. However, multibeam klystrons as heretofore proposed utilize magnetic focusing to constrain the electron beam. Magnetic focusing of a plurality of beams is difficult because some of the beams must be off the center axis of the tube, i.e., the symmetry axis of the magnetic field is not the same for all the beams. All but one of the electron beams must be off the symmetry axis of the magnetic field of the klystron. Other beams must cross magnetic field lines and, in so doing, they are defocused. Complex magnetic systems have been proposed in an attempt to correct this problem, but add to the expense and weight of the device.

SUMMARY OF THE INVENTION

In accordance with one aspect of the present invention, a multibeam klystron is electrostatically focused, eliminating the weight, size, and costs of complicated magnetic structures. The plurality of beams can be accurately focused leading to enhanced efficiency and bandwidth.

In accordance with another aspect of the present invention, electrostatic focusing is accomplished at the cavity gap on one or all of the cavities in the klystron by providing a focusing voltage thereacross.

In accordance with another aspect of the present invention, a klystron structure, including the electrostatic focusing aspects thereof, is enclosed within a glass envelope and supported therewithin on a plurality of longitudinally extending glass rods that accurately align the elements of the klystron. This construction is an improvement over the heavy construction heretofore employed in magnetic focusing, and moreover, the magnetic focusing would not be suitable for a glass envelope environment, either inside or outside the envelope.

In accordance with another aspect of the present invention, the intermediate construction of the klystron suitably comprises a plurality of metal disk members stacked in immediately adjacent relation, separated only by a thin layer of insulating material, desirably Kapton. Certain of the disk members are recessed to form toroidal cavities. The entire disk stack is easily accommodated and supported from glass rods extending longitudinally within the aforementioned glass envelope.

It is accordingly an object of the present invention to provide an improved high frequency, high bandwidth klystron.

It is another object of the present invention to provide a klystron suitable for high power operation which is light in weight and small in overall size.

It is another object of the present invention to provide a klystron that is economical to manufacture.

The subject matter of the present invention is particularly pointed out and distinctly claimed in the concluding portion of this specification. However, both the organization and method of operation, together with further advantages and objects thereof, may best be understood by reference to the following description taken in connection with the accompanying drawings wherein like reference characters refer to like elements.

DRAWINGS

Figure 2:
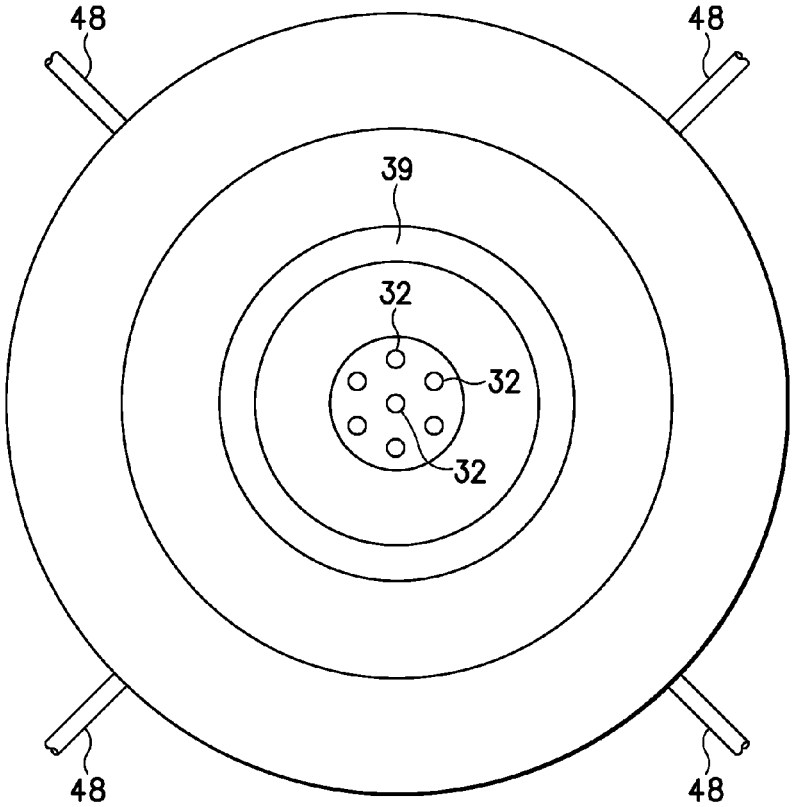
Figure 3:
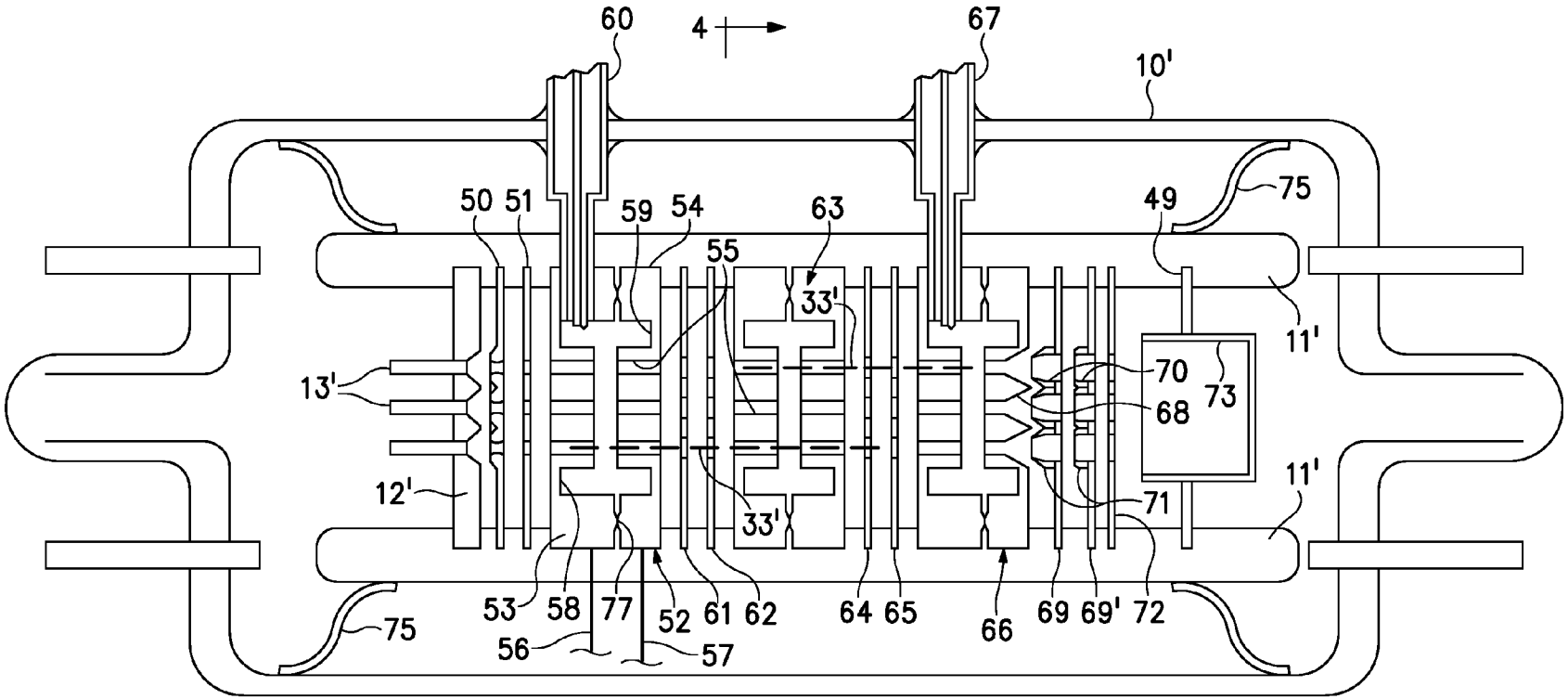
Figure 4:
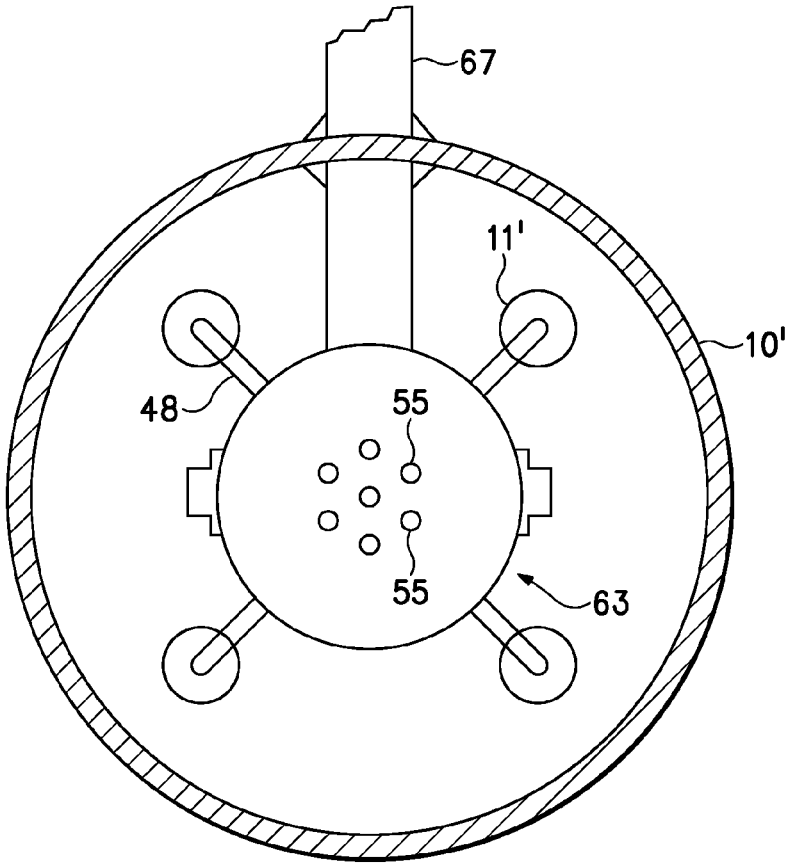

FIG. 1 is a longitudinal cross section of a klystron according to the first embodiment of the present invention, FIG. 2 is a lateral cross section taken at 2—2 in FIG. 1, FIG. 3 is a longitudinal cross section of a klystron according to a second embodiment of the present invention, and FIG. 4 is a lateral cross section of the last mentioned klystron taken at 4—4 in FIG. 3.

DETAILED DESCRIPTION OF THE PREFERRED EMBODIMENT

Referring to the drawings, and particularly to FIGS. 1 and 2, the klystron according to the present invention comprises a glass envelope 10 in which are disposed a plurality of longitudinally extending glass rods 11 upon which the remainder of the structure is supported. Although glass is preferred for the rods and envelope, other insulating material such as a ceramic can be substituted. The envelope construction suitable for embodiments of the invention is further seen in FIGS. 3 and 4. At one end of the envelope is located a cathode structure 12 including, in the specific embodiment, a plurality of small Pierce cathodes 13, here seven in number, that are symmetrically arranged with one center cathode and a group of six symmetrically surrounding and in the same plane with the first. Apertured disk member 14 in FIG. 1 provides an anode electrode having apertures or tunnels parallel with the disk axis and positioned for receiving electron beams 33 produced by cathodes 13. In the particular embodiment, disk member 14 is at minus 2000 volts, while the cathode structure is at minus 7000 volts. Disk member 14 also forms one side or section of a first toroidal input cavity for the klystron. A plurality of further stacked metal disk members or plates, 15–30, are disposed in alignment with disk member 14, being separated from one another as well as from disk member 14 by layers of insulating material 81, preferably Kapton, although other suitable insulators such as ceramic or mica can be substituted, the layer being thick enough to stand off the voltage applied between the various disk members 14–30. For Kapton, a 5 mil thickness is suitable for the klystron herein described.

Each of the disk members is provided with seven apertures or tunnels 32 in symmetrical array and in longitudinal alignment to pass the seven electron beams 33 produced by the cathode structure. In a particular example, disk members 15, 18, 20, 23, 25, 28 and 30 are at ground potential, while members 16, 17, 19, 21, 22, 24, 26, 27 and 29 are at minus 5000 volts. Various disk members are provided voltage by means of conductive leads such as those shown at 34 and 36.

A first microwave or input cavity 37 is formed by mating, annular, half cavity recesses 38 and 39 in disk members 14 and 15 respectively whereby to provide input and output sections of a toroidal shaped cavity which communicates with a central gap 35 between disks 14 and 15, through which the electron beams 33 pass. A coaxial input coupler passage 40 in disk 14 is employed for introducing r.f. energy into the input cavity via a coaxial cable (not shown) corresponding to cable 60 in the subsequent embodiment. As will be understood by those skilled in the art, the cavity 37 is proportioned to resonate at approximately the center operating frequency of the device.

Along the stack of disk members, further toroidal microwave cavities 41, 42 and 43 are formed respectively by facing half cavity recesses in disk members 19–20, 24–25, and 29–30. These remaining cavities are proportioned to resonate at the appropriate frequency of operation of the klystron device.

In between the disk members forming the microwave cavities, further disk members are disposed in stacked relation, e.g. disk members 16, 17 and 18 between the input cavity and the next intermediate cavity 41. These disk members are centrally recessed, as at 44, where they face one another, to provide central shallow spaces between disk members. In addition to the central recesses thus provided for example in disk members 16, 17 and 18, the disk members 15 and 19 at each end of the stack of three are similarly recessed to complete the configuration. The purpose of this construction is to enhance focusing.

At the output end of the klystron construction, the last disk member 30 provides an entrance to a collector means for the electron beams, disk member 30 having a thin, apertured inner wall 45 completing toroidal cavity 43, and a flared outer portion 46. Waveguide 47 is joined to the lower interior portion of member 30, communicating with output cavity 43 and from which the output of the device is secured. The device is provided with collector means following cavity 43, as in the case of the following embodiment.

As will be understood by those skilled in the art, electrons in the plural beams are alternately speeded up and slowed down under the influence of the field across the initial central gap of cavity 37 in response to the input provided. After passing through the input cavity 37, the electrons go through an ensuing drift space where they become "bunched". The electron beams are similarly bunched by interaction with succeeding cavities 41 and 42, and subsequently deliver their energy to the field of output cavity 43. In accordance with the present invention, the focusing of the electron beams is accomplished electrostatically by placing the alternate cavity sections at minus high voltage and up to zero volts potential, and all of the beams are focused equally and accurately. The multiple disks of this embodiment are easy to manufacture and assemble.

Now referring to FIGS. 3 and 4, illustrating a further embodiment according to the present invention, supported within glass envelope 10' are a plurality of glass rods 11' extending parallel to the longitudinal axis of the glass envelope. Although glass is preferred for the rods and envelope, other insulating material such as ceramic can be substituted. At one end of the envelope is located a cathode structure 12' including a plurality of small cathodes 13', here seven in number, that are symmetrically arranged with one center cathode and a group of six symmetrically surrounding it in the same plane with the first. The cathode structure is supported from glass rods 11', via pins 48. Apertured disk member 50, here comprising a relatively thin disk member supported by further pins 48 from rods 11', provides an electron gun anode electrode having apertures or tunnels axially parallel with the axis of the tube and positioned in spaced relation with the cathode structure for receiving parallel electron beams produced by the cathode 13'. Beyond the disk member 50 is another thin, pre-focus disk member 51 similarly having apertures for passing the electron beams and disposed in spaced relation along the path thereof from disk member 50.

Further yet along the path of the electron beams in spaced relation from thin disk 51 is a first cavity structure 52 comprising first and second sections 53 and 54 each of which is provided with tunnels 55 in registry for receiving the seven electron beams. The two sections 53 and 54 comprise conductive metal disk members that are secured to the glass rods via supporting pins. The two sections are closely adjacent, but being separated from each other by appropriate material, e.g. 5 mil Kapton, disposed between protruding facing, circular lands 77, whereby the Kapton insulates the two sections so they may reside at different voltages provided, for example, by connection means 56 and 57.

Half cavity recesses 58 and 59, formed in cavity sections 53 and 54 respectively, together provide a toroidal cavity which reacts with the electron beams from tunnels 55 in the spaced region or central gap between the two cavity member sections 53 and 54. Input to the cavity thus formed is delivered through coaxial cable 60 passing in sealed relation through the envelope with its outer conductive portion in electrical contact with cavity section 53, and having its central conductor looped within the cavity recess 59 around to the outer conductor to provide coupling of input energy to the cavity to thereby establish a field within the cavity. The cavity is dimensioned to resonate at the desired central frequency of operation of the apparatus. Electrons passing through the cavity structures 53 and 54 are alternately increased in velocity and decreased in velocity whereby "bunching" occurs. Voltages applied to the cavity sections 53 and 54, for example, via leads 56 and 57, provide electrostatic focusing of the electron beams 33'.

Additional thin disk members 61 and 62 are supported from glass rods 11' in spaced relation with cavity member 54 and with each other. They are apertured to receive the seven electron beams and are provided with appropriate voltage for continuing the electrostatic focusing thereof.

A second cavity structure 63, having the same construction as the cavity structure 52 except for the lack of an r.f. input, is next aligned along the paths of the electron beams and is secured in aligned relation by pins extending from glass rods 11'. The effect of the cavity structure 63 is further to enhance the bunching action as hereinbefore mentioned with regard to the previous embodiment. One such intermediate cavity structure is employed in this embodiment. After passing cavity structure 63, electrons pass through apertures in thin disk electrodes 64 and 65 spaced along the path of the electron beams. Again, focusing voltage is applied across the cavity structure 63.

A final or output cavity structure 66 is next encountered by the parallel electron beams and is disposed in spaced relation from thin disk electrode 65, being held in position from glass rods 11'. Cavity means 66 is similar in construction to cavity means 52 including a coaxial cable 67 passing through the envelope 10' in sealing relation thereto, and communicating with the interior of the cavity structure whereby to withdraw r.f. output. The sections of the output cavity device are likewise maintained at separate voltages to provide focusing. The tunnels at the beam output end of this cavity structure are flared at 68 where they face first collector electrodes 69 and 69', disposed in spaced relation further along the path of the electron beams and apertured at 70 to receive the electron beams. Aperture tunnels are surrounded by nozzle-like protuberances 71 facing upstream to enhance collection of electrons. A further thin apertured collector electrode 72 is positioned beyond disk 69' and is followed by a closed end, cylindrical collector member 73 secured to glass rods 11' via pins 49, collector member 73 having an interior diameter sufficient to receive the electron beams.

As in the case of the previous embodiment, disk and electrode members along the paths of the electron beams, including the cavity sections, are maintained at relatively positive and relatively negative voltage values whereby to provide the focusing of the beams. In a particular example, cathode structure 12' was maintained at a minus 7000 volts, the next electrode disk member 50 was at minus 2000 volts, and member 51 was at minus 1000 volts. Electrode member 53 was at minus 5000 volts, with members 61, 62, 64 and 65 being at minus 7000 volts. The input and output sections of each cavity were maintained at minus 5000 volts and minus 2000 volts respectively. Successive first and second members 69 and 69' were at minus 3000 volts and minus 4000 volts respectively, while cylinder 73 was maintained at minus 6000 volts. These values are, of course, by way of example.

In accordance with the present invention, respective conductive members in the klystron are supported via glass rods 11, 11' by way of pins 48, 49. This construction allows very accurate placement of the various components, whether spaced or stacked, at very low cost. The glass rod and envelope construction enables the tube structure to be simple and easy to manufacture. The glass rodded structure may be held in place within glass envelope 10' by springs such as shown at 75 in FIG. 3.

The klystron according to the present invention has numerous additional advantages such as very high efficiency and high bandwidth at comparatively high output levels and at relatively low voltage levels. Since several electron beams are employed, each beam can have relatively low perveance and thus provide high efficiency, and in the aggregate, for all the beams, the total power is comparatively high. The noise figure of the klystron employed as an amplifier is reduced due to the lower voltages required. Since the voltage is lowered, bunching occurs over a shorter distance, and the tube can be shorter than it otherwise would be. The entire construction employed as an amplifier also becomes smaller because high voltage standoff is reduced.

As known to those skilled in the art, a klystron can be employed as either an amplifier or an oscillator, and various feedback means can be provided externally or internally to enable oscillation, and, as hereinbefore indicated, the lack of the requirement of heavy magnetic structure lightens the weight of the device and substantially reduces its size.

While preferred embodiments of the present invention have been shown and described, it will be apparent to those skilled in the art that many changes and modifications may be made without departing from the invention in its broader aspects. The appended claims are therefore intended to cover all such changes and modifications that fall with the true spirit and scope of the invention.

What is claimed is:

1. A klystron construction comprising:

an electron gun structure providing a plurality of electron beams, collector means receiving said electron beams, and means intermediate said gun structure and said collector means through which said electron beams pass, said intermediate means comprising toroidal cavities receiving said electron beams proximate the toroidal axes thereof, means providing an r.f. input to a first of said cavities and means receiving an r.f. output from another of said cavities farther along the path of said electron beams, wherein ones of said cavities comprise an input section, and an output section electrically insulated from the input section, and means for providing a voltage between said sections for electrostatically focusing said electron beams.

2. The klystron construction according to claim 1 further including:

an elongated envelope enclosing said electron gun structure, said collector means, and said intermediate means, said envelope being formed of insulating material, and a plurality of insulating rods supported within said envelope and in turn supporting said electron gun structure, said collector means and said intermediate means.

3. The klystron construction according to claim 1 wherein at least said intermediate means comprise a plurality of adjacent conductive members centrally apertured to pass said electron beams, and including insulating material separating certain next adjacent ones of said adjacent conductive members, and wherein said certain next adjacent ones of said members are centrally recessed to form said input and output sections of said cavities.

4. The klystron construction according to claim 3 wherein said conductive members comprise stacked metal disk members.

5. The klystron construction according to claim 4 wherein said insulating material comprises an insulating material with high dielectric constant and low RF loss.

6. The klystron construction according to claim 3 further including:

an elongated envelope enclosing said electron gun structure, said collector means, and said intermediate means, said envelope being formed of insulating material, and a plurality of insulating rods disposed within said envelope, said conductive members being secured to said insulating rods.

7. The klystron construction according to claim 6 wherein ones of said conductive members are supported in spaced relation by said insulating rods.

8. The klystron construction according to claim 6 wherein said conductive members comprise a stack of metal disk members.

9. The klystron construction according to claim 1 including at least three such cavities, including at least one additional cavity between said first of said cavities and said another of said cavities along the path of said electron beams.

10. The klystron construction according to claim 4 wherein said insulating material comprises insulating sheet with high dielectric strength to prevent voltage breakdown and high dielectric constant to confine RF fields and low loss tangent to maintain cavity Q.

11. The klystron construction according to claim 10 wherein said insulating material comprises alumina.

12. The klystron construction according to claim 4, wherein said insulating material comprises ceramic or mica.

13. The klystron construction according to claim 12 wherein said insulating material comprises alumina.

* * * * *